US007243501B2

(12) United States Patent
Yahia et al.

(10) Patent No.: US 7,243,501 B2
(45) Date of Patent: Jul. 17, 2007

(54) EXPANSION DEVICE FOR AN AIR-CONDITIONING SYSTEM

(75) Inventors: Mohamed Ben Yahia, Paris (FR); Jin-Ming Liu, Conflans St Honorine (FR)

(73) Assignee: Valeo Climatisation, La Verriere (FR)

( * ) Notice: Subject to any disclaimer, the term of this patent is extended or adjusted under 35 U.S.C. 154(b) by 63 days.

(21) Appl. No.: 11/102,901

(22) Filed: Apr. 8, 2005

(65) Prior Publication Data

US 2005/0223740 A1 Oct. 13, 2005

(30) Foreign Application Priority Data

Apr. 9, 2004 (FR) ..... 04 03766

(51) Int. Cl.
*F25B 41/04* (2006.01)
*F25B 41/06* (2006.01)

(52) U.S. Cl. ..... 62/222; 62/527

(58) Field of Classification Search ..... 62/222, 62/225, 511, 224, 527, 324.6; 138/45, 46
See application file for complete search history.

(56) References Cited

U.S. PATENT DOCUMENTS

| | | | | |
|---|---|---|---|---|
| 3,252,294 | A * | 5/1966 | Heidorn | 62/207 |
| 4,100,759 | A * | 7/1978 | Tyree, Jr. | 62/50.1 |
| 4,951,478 | A * | 8/1990 | McDonald | 62/222 |
| 5,195,331 | A * | 3/1993 | Zimmern et al. | 62/202 |
| 5,642,858 | A * | 7/1997 | Kakehashi et al. | 236/92 B |
| 6,230,506 | B1 | 5/2001 | Nishida et al. | |
| 6,430,950 | B1 | 8/2002 | Dienhart et al. | |
| 6,543,239 | B2 * | 4/2003 | Dienhart et al. | 62/199 |
| 6,799,601 | B2 * | 10/2004 | Bauer et al. | 137/565.11 |
| 6,857,281 | B2 * | 2/2005 | Wightman | 62/222 |
| 6,915,648 | B2 * | 7/2005 | Wightman | 62/222 |

FOREIGN PATENT DOCUMENTS

| | | | |
|---|---|---|---|
| DE | 10219667 | A | 11/2003 |
| FR | 2841829 | | 1/2004 |
| JP | 11248272 | A | 9/1999 |
| JP | 2002-316531 | A * | 10/2002 |
| WO | WO01/06183 | | 1/2001 |
| WO | WO01/27543 | | 4/2001 |

* cited by examiner

*Primary Examiner*—Mohammad M. Ali
(74) *Attorney, Agent, or Firm*—Ronald Courtney

(57) ABSTRACT

An expansion device, intended for installation in an air conditioning system with a supercritical refrigerant fluid (FR), is described. The expansion device (12) comprises a body (120) through which refrigerant fluid passes, equipped with an inlet chamber (1210) into which the refrigerant fluid arrives and an outlet chamber (1230) through which the refrigerant fluid departs. The expansion device further comprises a set of expansion means to allow the refrigerant fluid to pass from the inlet chamber (1210) to the outlet chamber (1230), comprising a variable expansion means (1212) comprising a first orifice (34) and an adjusting screw (134) suitable for adjusting the flow section of the first orifice (34); and, a fixed expansion means comprising a second orifice (35) with a fixed flow section.

20 Claims, 6 Drawing Sheets

EXPANSION DEVICE FOR AN AIR-CONDITIONING SYSTEM

The invention relates to air conditioning systems, notably for motor vehicles.

A standard air conditioning system comprises a compressor, a gas cooler, an expansion device and an evaporator through which a refrigerant fluid passes in the above order. The refrigerant fluid is compressed in gaseous phase and brought to a high pressure via the compressor. It is then cooled by air which passes through the gas cooler, then loses pressure upon passing through the expansion device. The fluid then partially evaporates. At the outlet of the expansion device, the refrigerant fluid is in the form of a mix of low pressure steam and liquid, which is directed to the evaporator where it is transformed into gaseous phase. An internal exchanger can also be provided upstream of the expansion device.

In current models, the expansion device is a choke. Such an expansion device can be easily connected to the other parts of an air conditioning system, owing to its straightforward structure. However, the performance of a choke in the regulation of the flow of refrigerant fluid according to the thermal load conditions are sometimes insufficient and do not allow for an optimal coefficient of performance. Hence, an accumulator is also used at the outlet of the evaporator to prevent an excessively high flow of refrigerant fluid entering the evaporator and to prevent slugging at the compressor. This accumulator corresponds to a storage zone for the non-flowing load of refrigerant fluid. This storage zone can increase or decrease depending on the operating conditions. Consequently, the accumulator must be particularly voluminous, which increases the space required for the air conditioner.

In other current models, an expansion device with a variable orifice is used. Notably, we know of expansion mechanisms in which the flow section of the expansion device varies according to the high pressure or according to the difference between the high pressure and the low pressure.

Document JP56-74575 proposes, for example, an expansion device for an air conditioning apparatus through which R134a refrigerant fluid flows. The expansion device comprises a valve whose degree of opening varies according to the difference between the high pressure and the low pressure. More precisely, the valve opens when the difference between the high pressure and the low pressure is great and closes when the difference between the high pressure and the low pressure is small.

Such an expansion device has an optimal coefficient of performance which depends on the high pressure as well as the low pressure. This results in a costly and complex structure.

Document U.S. Pat. No. 5,081,847 proposes, for example, an air conditioning apparatus for motor vehicles through which a subcritical refrigerant fluid R134a flows, in which the expansion device has a variable orifice. The expansion device comprises a main central orifice that is always open, and at least one peripheral orifice that opens or closes according to the high pressure of the refrigerant fluid so as to optimize the cooling down of the passenger compartment.

Here, the degrees of opening of the expansion device depend only on the high pressure. However, such an expansion device is intended to operate using a subcritical refrigerant fluid and is unsuitable for supercritical refrigerant fluids.

The use of supercritical fluids, notably refrigerant fluid $CO_2$ (R744), develops in the air conditioning systems of vehicles so as to limit the harmful effects of refrigerant fluids on the environment, and it is therefore appropriate to adapt air conditioning systems to such fluids.

Expansion devices capable of operating with refrigerant fluid $CO_2$ are known. However, these devices usually require electronic controls and are consequently relatively costly, making them inappropriate for motor vehicle air conditioning systems.

The invention improves the situation.

To this end, it proposes an expansion device intended to be installed in an air conditioning system operating with a supercritical type refrigerant fluid, and comprising a body through which the refrigerant fluid is to pass. The body comprises an inlet chamber into which the refrigerant fluid arrives and an outlet chamber through which the refrigerant fluid departs. The expansion device further comprises a set of expansion means to allow the refrigerant fluid to pass from the inlet chamber to the outlet chamber. Advantageously, the expansion means comprise:

variable expansion means comprising a first orifice and an adjusting screw in order to adjust the flow section of the first orifice, and fixed expansion means comprising a second orifice (35) with a fixed flow section.

Optional additional or replacement features of the invention are detailed below:

The first orifice and the second orifice are adjacent and non-intersecting.

The first orifice and the second orifice are arranged so as to create form a common orifice.

The expansion means are designed so that the minimum flow section of the expansion device is substantially between 0.07 $mm^2$ and 0.16 $mm^2$.

The expansion means are laid out so that the flow section of the expansion device is substantially between 0.45 $mm^2$ and 0.63 $mm^2$, when the pressure of the refrigerant fluid is substantially about 110 bars.

The expansion means are laid out so that the flow section of the expansion device is substantially between 0.71 $mm^2$ and 0.95 $mm^2$, when the pressure of the refrigerant fluid is substantially about 135 bars.

The expansion means are laid out so that the flow section of the expansion device substantially lies between 2 $mm^2$ and 6.1 $mm^2$, when the pressure of the refrigerant fluid is substantially greater than or equal to 135 bars.

The flow section of the second orifice is substantially between 0.07 $mm^2$ and 0.16 $mm^2$.

The adjusting screw is designed to close the first orifice when the pressure of the refrigerant fluid is substantially less than 80 bars and to open the first orifice, at least partially, when the pressure of the refrigerant fluid in the inlet chamber is substantially greater than or equal to 80 bars.

The adjusting screw is designed to adjust the flow section of the first orifice according to the pressure of the refrigerant fluid in the inlet chamber, in a generally increasing manner, when the pressure of the refrigerant fluid in the inlet chamber substantially lies between 80 bars and 135 bars.

The adjusting screw is designed to maintain a maximum opening of the first orifice, when the pressure of the refrigerant fluid in the inlet chamber is substantially greater than or equal to 135 bars.

The expansion means further comprise a plugging mechanism comprising a third orifice and a stopper to plug the third orifice.

The stopper is designed to plug the third orifice when the pressure of the refrigerant fluid in the inlet chamber is substantially less than 135 bars, and to open the third orifice when the pressure of the refrigerant fluid in the inlet chamber is substantially greater than or equal to 135 bars.

The variable expansion means further comprise a spring system laid out to apply a force on the adjusting screw in opposition to the force applied by the pressure of the refrigerant fluid which enters the inlet chamber.

The variable expansion means are laid out in a recess in the inlet chamber, and the adjusting screw comprises a spindle substantially perpendicular to the axis of the first orifice, attached at one of its ends to the base of the recess. The spindle is mechanically connected to a partition to which, on one hand, the force of the spring system is applied and, on the other hand, the force of the pressure of the entering refrigerant fluid is applied, so that the adjusting screw is suitable for moving in translation, substantially perpendicular to the axis of the orifice.

The refrigerant fluid is the R744 fluid.

The invention also relates to an air conditioning system, operating with a refrigerant fluid and comprising a compressor, a gas cooler, an expansion device and an evaporator. Advantageously, the expansion device is as defined by one of the above features.

Other features and advantages of the invention will become apparent upon examination of the following description and the appended drawings in which.

The drawings essentially contain fixed elements. They can therefore provide a better understanding of the description as well as contribute to the definition of the invention, if need be.

Figure 1:
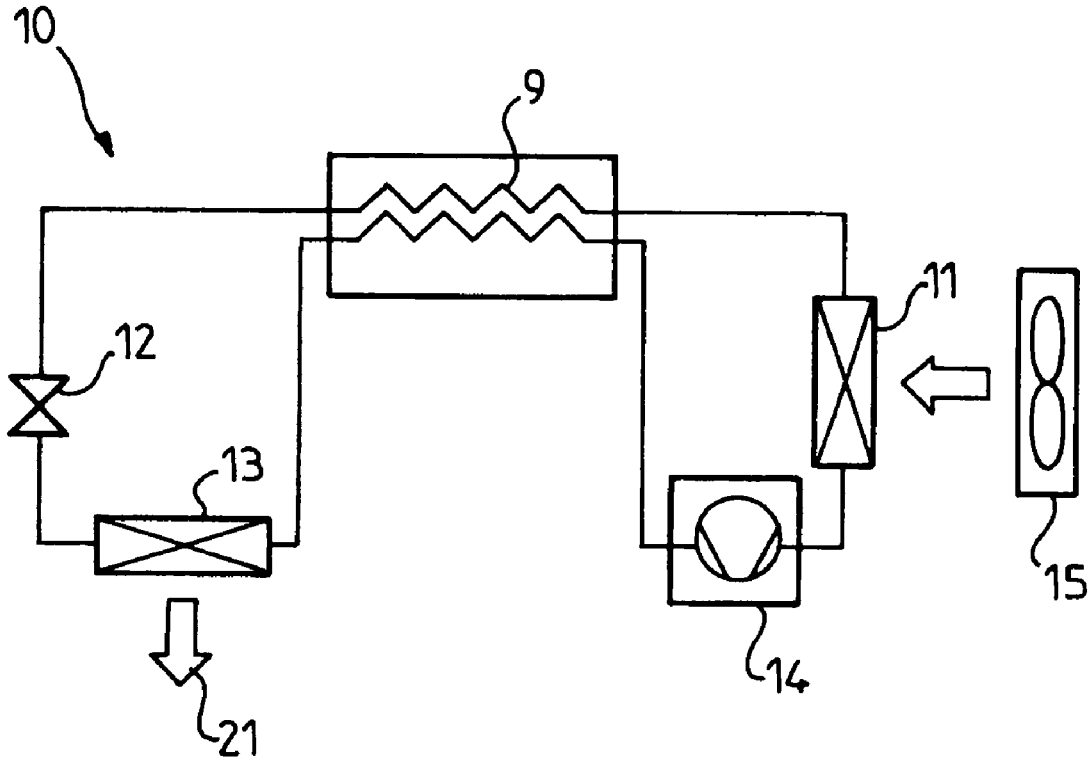
FIG. 1 is a diagram of an air conditioner operating according to a supercritical cycle.

Reference is first made to FIG. 1, which represents a diagram of an air conditioning system 10 intended to be integrated into a motor vehicle. A refrigerant fluid is circulated through the air conditioning system. The system further comprises:

a compressor 14 to receive the fluid in gaseous form and to compress it, a gas cooler 11 for cooling the gas compressed by the compressor, an expansion device 12 to lower the pressure of the fluid, and an evaporator 13 to change the fluid issuing from the expansion device from the liquid state into the gaseous state in order to produce a stream of cooled air 21, which can be directed towards the passenger compartment of the vehicle.

The system can further comprise an internal heat exchanger 9, allowing the fluid circulating from the gas cooler to the expansion device to release its heat to the fluid circulating from the evaporator to the compressor.

The compressor 14 can be an electric or mechanical compressor.

The cooling mechanism 11 receives a stream of air in order to evacuate the heat removed from the refrigerant fluid, which, under certain operating conditions, is set in motion by a ventilation unit 15.

A supercritical fluid, for example refrigerant fluid $CO_2$, usually indicated by the reference R744, is circulated through the air conditioning system.

Figure 2A:
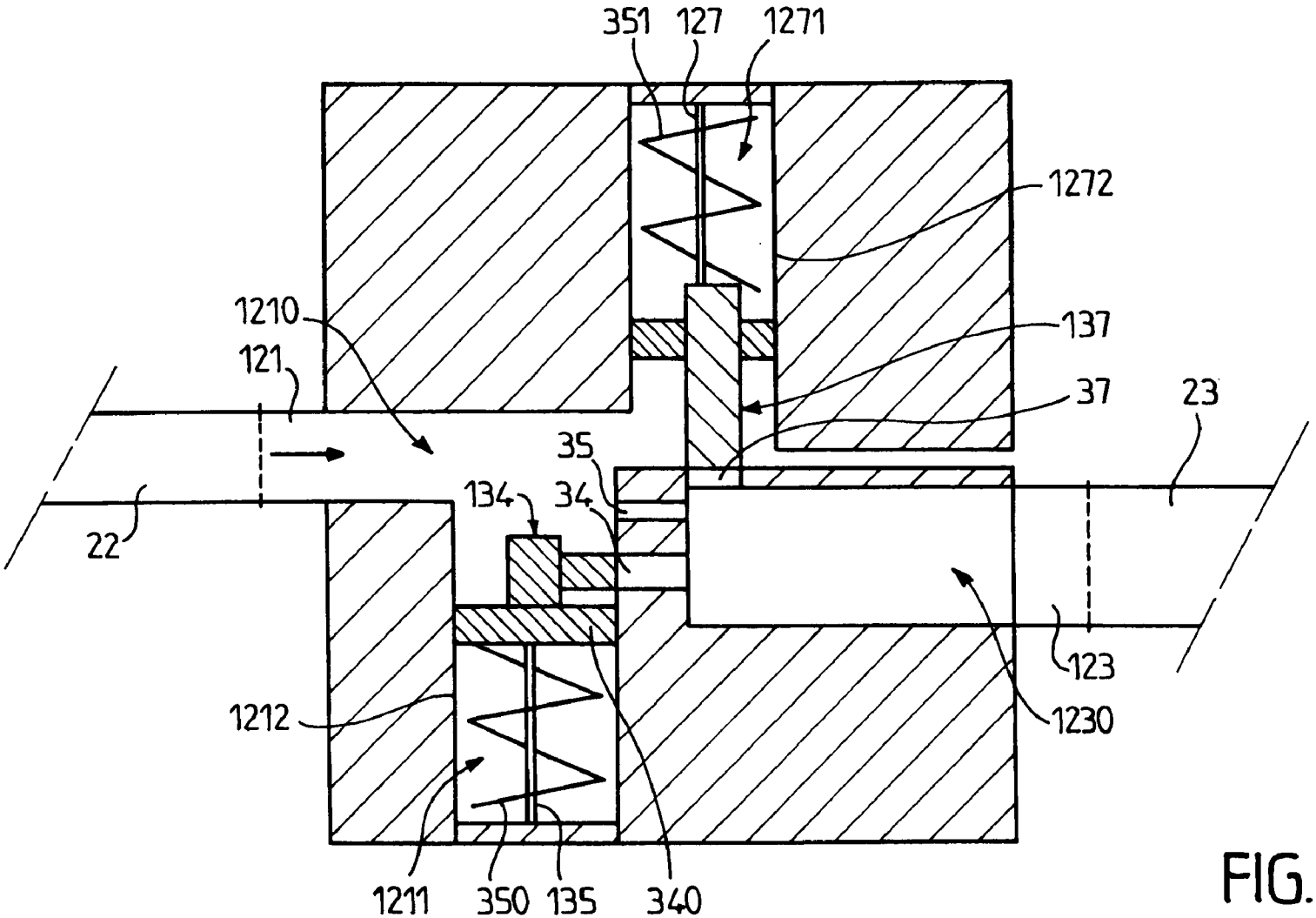
FIG. 2A is a cross-section view of a expansion device according to a first embodiment of the invention.

Reference is first made to the expansion device in FIG. 2A, which is a cross-section view of the expansion device 12 of the invention.

The expansion device 12 comprises a body 120, which can have an overall parallelepiped form. It can be made, for example, of aluminum.

The body 120 is equipped with an inlet chamber 1210 which receives the refrigerant fluid FR under high pressure Hp. This inlet chamber comprises an inlet 121, intended to be connected to a gas cooler via a connection hose 22. Of course, the connection between the expansion device and the gas cooler via the connection hose 22 can be indirect when other elements of the system, for example the internal heat exchanger 9, are used on the gas cooler/evaporator line. The inlet 121 can be in the form of a traditionally horizontal inlet channel. The "horizontal" direction here, as well as in the rest of the description, refers to the overall delivery direction of the refrigerant fluid in the connection pipes of the system.

The body 120 comprises an outlet chamber 1230 which is connected to the inlet chamber 1210. The refrigerant fluid FR which enters the outlet chamber 1230 is in a state of low pressure Bp, following an expansion of the refrigerant fluid.

The outlet chamber 1230 comprises an outlet 123 intended to be connected to the evaporator 13 via a connection hose 23. The refrigerant fluid which enters the second outlet chamber 1230 leaves the expansion device via the outlet 123.

The expansion device 12 comprises a set of expansion means which cause the refrigerant fluid to pass from the inlet chamber 1210 into the outlet chamber 1230, by lowering its pressure. The expansion means comprise variable expansion means 1211 and fixed expansion means 35.

The variable expansion means 1211 comprise a first orifice 34 and an adjusting screw 134 which adjusts the flow section of the first orifice. The fixed expansion means comprise a second orifice 35 with a fixed flow section. The refrigerant fluid can pass from the inlet compartment 1210 to the outlet compartment 1230 via the orifices 34 and 35.

The variable expansion means 1211 can be laid out in the recess 1212, for example a vessel-shaped lower recess. They are subjected to the high pressure of the refrigerant fluid which enters from the inlet channel 121.

The first orifice 34 of the variable expansion means has a variable flow section. Some of the refrigerant fluid from the inlet chamber 1210 can thus be retained by the first orifice prior to entering the outlet chamber 1230. The first orifice 34 can have more than one degrees of opening.

The second orifice 35 of the fixed expansion means has a fixed flow section. Thus, some of the refrigerant fluid from the inlet chamber 1210 can also be retained in the second orifice prior to entering the outlet chamber 1230.

Additionally, the expansion means can comprise a plugging mechanism 1271 inserted into an auxiliary recess 1272, for example a vessel-shaped upper recess. The description below refers to an expansion device 12 comprising such a plugging mechanism by way of non-restrictive example.

The plugging mechanism is subjected to the high pressure of the refrigerant fluid issuing from the inlet channel 121. The plugging mechanism comprises a third orifice 37, in which some of the refrigerant fluid from the inlet chamber 1210 can be retained prior to entering the outlet chamber 1230. The plugging mechanism further comprises a stopper 137 which works in conjunction with the third orifice 37 in order to plug it or to open it up. The third orifice 37 can thus be in an open state or in a closed state.

The refrigerant fluid $CO_2$ which enters the inlet 121 flows into the inlet chamber.

The inlet chamber 1210 can thus be connected to the outlet chamber 1230 via the variable expansion means 1211, the fixed expansion means 35 and the plugging mechanism 1271.

In accordance with an embodiment of the invention, illustrated in FIG. 2A, the first orifice 34 of the variable expansion means and the second orifice 35 of the fixed expansion means can be adjacent and non-intersecting. According to this embodiment, the adjusting screw 134 can adjust the flow section of the first orifice whereas the second orifice 35 remains open.

Figure 2B:
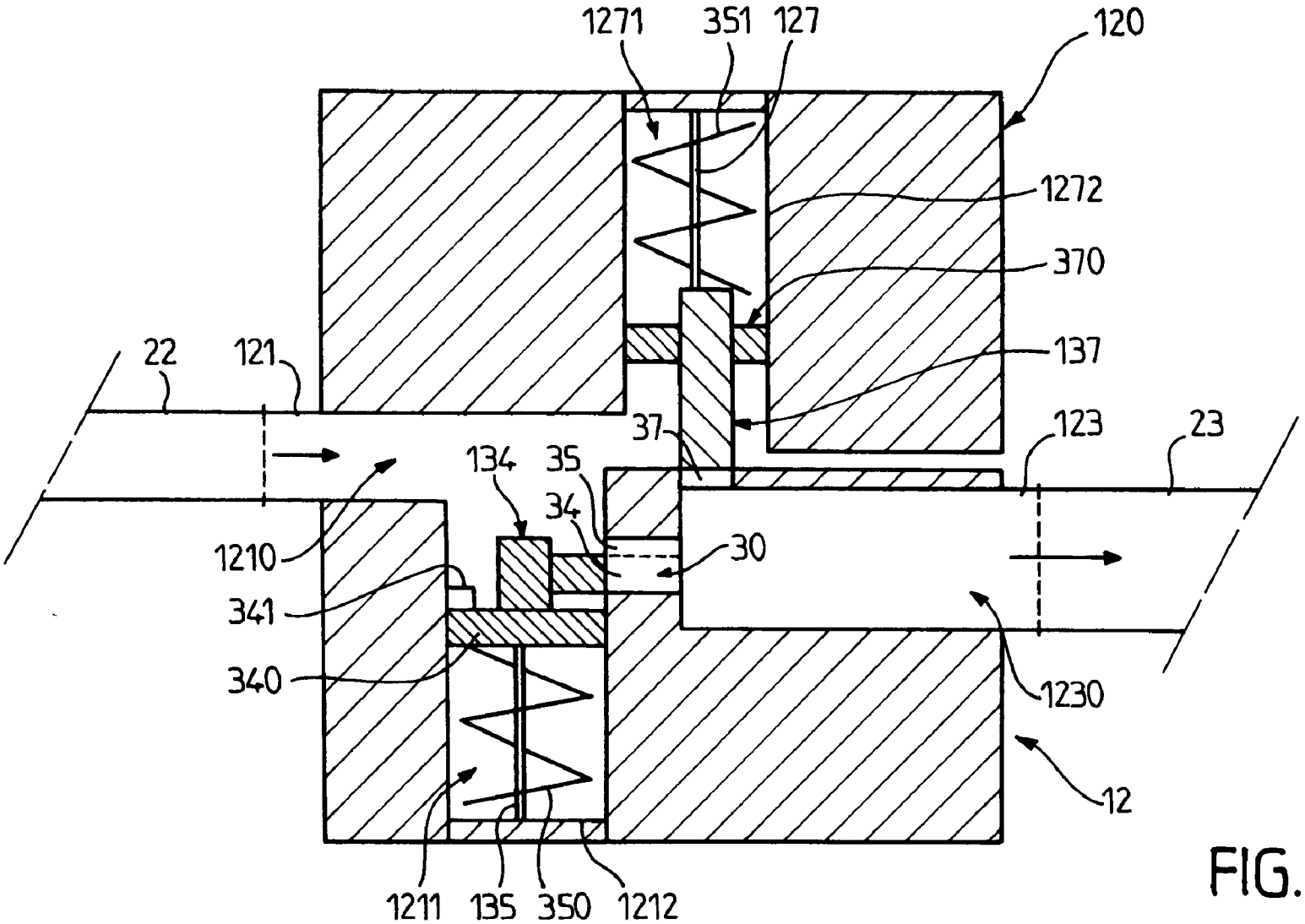
FIG. 2B is a cross-section view of an expansion device according to a second embodiment of the invention.

In another embodiment of the invention, illustrated in FIG. 2B, the first orifice 34 of the variable expansion means and the second orifice 35 of the fixed expansion means can be adjacent and together create a common orifice 30. In FIG. 2B, the dotted line defines the border between the first orifice 34 and the second orifice 35. In this embodiment, there is no physical separation between the first orifice 34 and the second orifice 35, but only the common part of the orifice corresponding to the first orifice has a variable flow section. For this reason, the adjusting screw 134 is used to adjust the flow section of only the first orifice, whereas the second orifice 35 remain open.

The adjusting screw 134 of the variable expansion means can comprise a spindle 135, substantially perpendicular to the axis of the first orifice 34. In the examples of FIGS. 2A and 2B, the spindle is vertical. The description below refers to a vertical spindle, by way of non-restrictive example. The spindle 135 is fixed at one of its ends to the base of the recess. Additionally, it is mechanically connected to a partition 340, which can be a membrane or a piston. The description below refers to a piston 340 by way of non-restrictive example.

The vertical displacement of the adjusting screw 134 is subjected to the high pressure Hp of the refrigerant fluid FR which enters into the expansion device via the inlet 121, owing to a spring system 350 inserted into the recess 1212.

The adjusting screw 134 is then subjected to the force applied by the high pressure Hp of the refrigerant fluid FR which enters the expansion device, and to the thrust of the spring 350. These forces are applied to the piston 340 of the variable expansion means.

Depending on the values of these forces, the adjusting screw 134 can be displaced vertically, which alters the flow section of the first orifice 34.

Thus, the degree of opening of the first orifice 34 depends only on the high pressure Hp and on the thrust of the spring which applies a return force.

More precisely, when the high pressure Hp of the refrigerant fluid is lower than a first threshold value, the adjusting screw 134 closes the first orifice 34 in order to plug it, and the variable expansion means have no effect on the flow of the $CO_2$ fluid.

When the high pressure Hp of the refrigerant fluid is greater than or equal to this first threshold value, the adjusting screw 134 starts to open the first orifice 34, so that its flow section starts to increase, thus allowing the passage of some of the refrigerant fluid towards the outlet chamber 1230.

In the embodiment in FIG. 2B, the upward translation of the adjusting screw can be limited with a set of stoppers, notably an upper stopper 341, when the partition 340 is a piston. The piston 340 then pushes against the stopper 341 when the upper end of the adjusting screw reaches the second orifice 35. Thus, the stopper 341 limits the sliding movement of the piston 340, which prevents the adjusting screw 134 from altering the flow section of the second orifice 35.

The upper stopper 341 is arranged in the side partition of the recess 1212. The upper stopper 341 prevents the adjusting screw 134 from reducing the flow section of the second orifice 35.

The size and the shape of the upper end of the adjusting screw 134 are selected according to the size and shape of the first orifice 34.

The plugging mechanism 1271 can be inserted into the upper recess 1272, located downstream from the variable expansion means 1210.

The plugging mechanism 1271 can be a relief valve. It thus comprises an auxiliary spring system 351 and the stopper 137 working in conjunction with the spring system.

The stopper 137 can comprise an auxiliary spindle 138, substantially aligned with the axis of the third orifice 37. In the examples of FIGS. 2A and 2B, the auxiliary spindle 138 is vertical. The description below refers to an. auxiliary vertical spindle 138, by way of non-restrictive example. The spindle 138 is attached at one of its ends to the base of the auxiliary recess 1272. Additionally, it is mechanically connected to an auxiliary partition 370, which can notably be a piston.

The other end of the auxiliary spindle is formed according to the third orifice 37 and, in particular, has a flow section substantially equal to the flow section of the third orifice 37.

The piston of the stopper 137 is subject to the force applied by the high pressure Hp of the refrigerant fluid FR which enters and the thrust of the auxiliary spring system 351.

Thus, depending on the values of these forces, the stopper 137 can move vertically. More precisely, when the high pressure Hp of the refrigerant fluid is lower than a second threshold value, the stopper 137 penetrates the third orifice 37 in order to plug it, and the relief valve has no effect on the flow of $CO_2$ fluid.

When the pressure Hp of the refrigerant fluid is greater than or equal to this second threshold value, the stopper 137 rises in order to open the third orifice 37, and thus allows the some of the refrigerant fluid to pass into the outlet chamber 1230.

The relief valve 127 protects the air conditioning system when the high pressure Hp of the refrigerant fluid reaches excessive values.

The expansion device according to the invention can be modeled by an orifice with an equivalent variable flow section depending on the high pressure of the refrigerant fluid in the inlet chamber. This equivalent flow section corresponds to the sum of the respective flow sections of the variable expansion means 1211, the fixed expansion means 35 and the plugging mechanism 1271.

In a motor vehicle air conditioning system, the value of the high pressure Hp of the refrigerant fluid which enters the expansion device is linked to the heat load, and therefore to the user's demand for cold and/or to the external temperature.

The expansion device 12 of the invention is made to control the flow of fluid which passes through the orifices 34, 35 and 37 of the expansion means, depending on the heat load.

Figure 3:
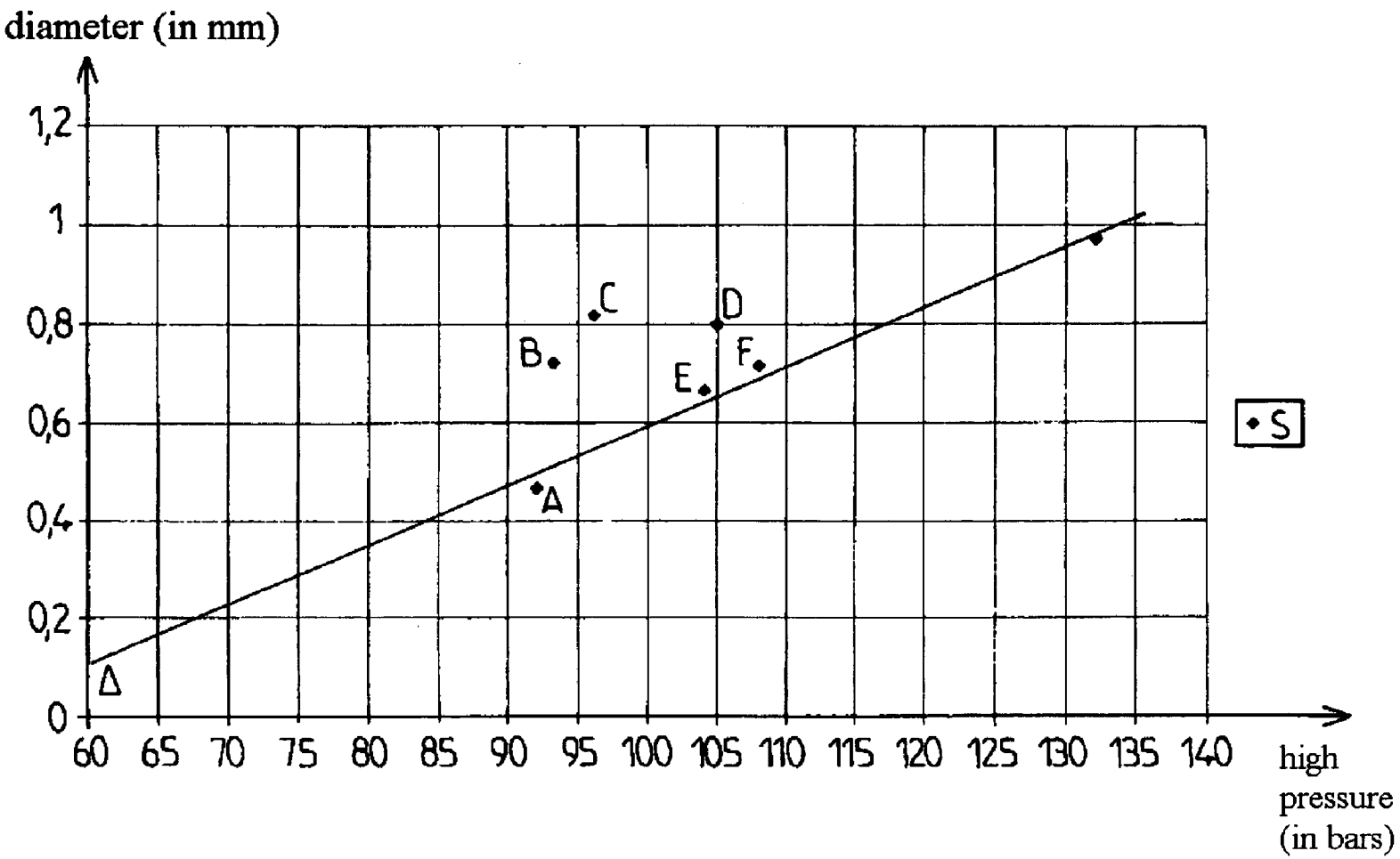
FIG. 3 is a diagram illustrating the change in diameter of an expansion orifice depending on the high pressure.

FIG. 3 is a diagram illustrating an optimal model of change in the diameter of a variable expansion orifice depending on the high pressure Hp of the refrigerant fluid. The straight line Δ in this figure corresponds to a model of a variable orifice made from gauging points A to F. This figure demonstrates that the flow section of a variable orifice must be a substantially increasing function of the high pressure Hp so that the coefficient of performance is optimal.

Figure 4:
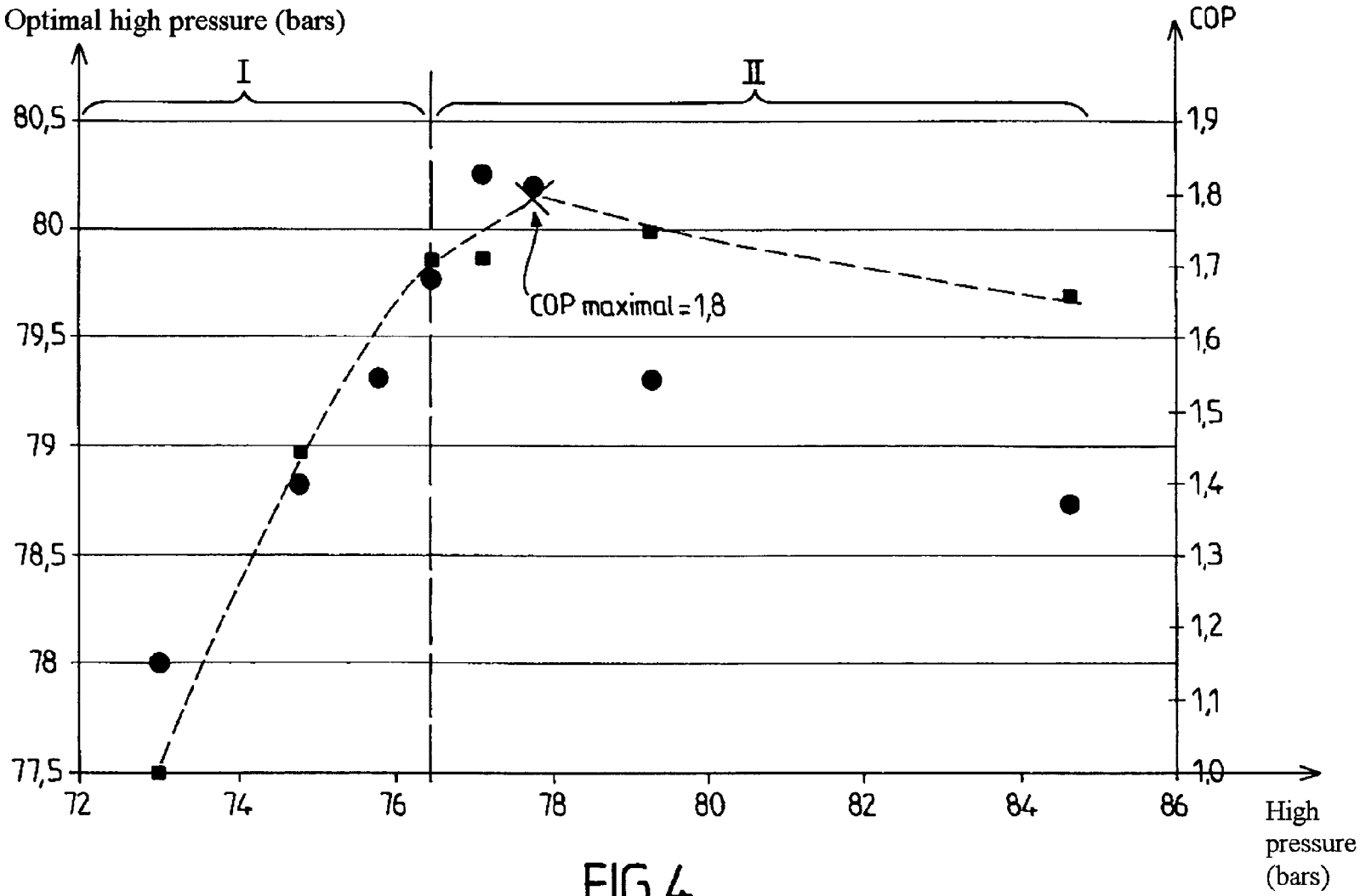
FIG. 4 is a diagram illustrating the change in the coefficient of performance depending on the high pressure, in an air conditioning system equipped with an expansion device with a variable orifice.

FIG. 4 is a diagram illustrating the development of the coefficient of performance COP depending on the high pressure Hp. It is noted that a satisfactory coefficient of performance can be obtained for the high pressure values in the vicinity of 80 bars. If the high pressure is less than about 76 bars, as illustrated in part I of FIG. 4, the coefficient of performance COP if greatly diminished. If the high pressure is substantially greater than 76 bars and substantially lower than 84 bars, as illustrated in part II of FIG. 4, the coefficient of performance COP is considerably less affected. The expansion device of the invention is notably arranged so as to maintain the coefficient of performance in its optimal zone, and therefore to bring the high pressure of the refrigerant fluid into an optimal pressure zone, substantially between 76 bars and 84 bars.

In the air conditioning systems of the prior art, at low heat load, the minimum diameter of the orifice of an expansion device is usually selected without taking into account the real operating conditions, typically about 0.6 mm. This minimum value engenders a non-optimized high pressure Hp value in relation to the real operating conditions, which could result in excessive consumption by the motor. This type of expansion device is insufficient at a low heat load.

The applicant found that by imposing an equivalent minimum flow section especially adapted to the expansion device, at a low heat load, a high pressure is obtained near this optimal pressure zone, as is an optimized coefficient of performance. More precisely, the applicant found that an equivalent minimum flow section of the expansion device S1, substantially between 0.07 $mm^2$ and 0.16 $mm^2$, at low heat load, ensures a high pressure Hp of the refrigerant fluid substantially greater than 80 bars for the majority of the points of the cycle for which the temperature of the refrigerant fluid at the outlet of the gas cooler is about 30° C. Such a minimum flow section S1 can correspond to an equivalent minimum diameter between 0.3 mm and 0.45 mm.

Figure 5:
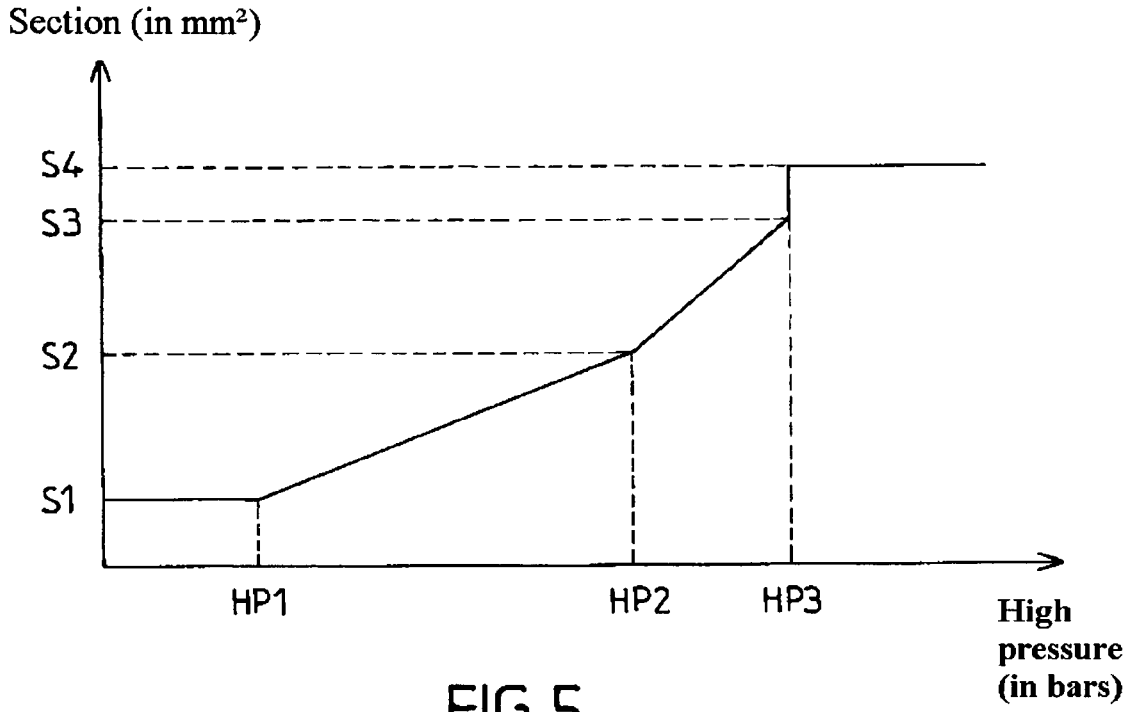
FIG. 5 is a diagram illustrating an example of a change in the flow section of an expansion device according to the invention depending on the high pressure.

FIG. 5 illustrates the change in the equivalent flow section of an expansion device according to the invention, depending on the high pressure Hp values of the refrigerant fluid. Thus, according to an aspect of the invention, the expansion means are designed so that the equivalent minimum flow section S1 of the expansion device is advantageously between 0.07 $mm^2$ and 0.16 $mm^2$. This equivalent minimum flow section S1 enables the high pressure of the refrigerant fluid to be brought back to its optimal zone, notably in the vicinity of 80 bars.

According to another aspect of the invention, the expansion means are additionally designed so that the equivalent flow section of the expansion device goes from the value S1 to a value S2 substantially between 0.45 $mm^2$ and 0.63 $mm^2$, when the high pressure of the refrigerant fluid reaches a value Hp2 substantially equal to 110 bars.

Additionally, the expansion means are designed so that the equivalent flow section of the expansion device reaches a value S3, substantially between 0.71 $mm^2$ and 0.95 $mm^2$, when the high pressure of the refrigerant fluid reaches a value Hp3 substantially equal to 135 bars.

Furthermore, the expansion means are designed so that the equivalent flow section of the expansion device remain substantially equal to a value S4, substantially between 2 $mm^2$ and 6.1 $mm^2$ when the high pressure of the refrigerant fluid is substantially greater than or equal to 135 bars.

According to another aspect of the invention, the flow section of the second orifice 35 can be substantially between 0.07 $mm^2$ and 0.16 $mm^2$. The variable expansion means 1211 are additionally designed so that the adjusting screw 134 closes the first orifice 34, when the high pressure Hp of the refrigerant fluid is substantially lower than 80 bars, and starts to open the first orifice 34, when the high pressure Hp of the refrigerant fluid is about 80 bars.

To accomplish this, the characteristics of the spring system 350 of the variable expansion means can be selected so that the adjusting screw 134 closes the first orifice 34, when the pressure of the refrigerant fluid which enters the inlet chamber is substantially less than 80 bars, and starts to open the first orifice in the vicinity of 80 bars.

The variable expansion means 1211 are additionally designed so that the flow section of the first orifice 34 varies with the high pressure Hp of the refrigerant fluid, in a generally increasing manner, when the high pressure Hp of the refrigerant fluid is substantially between 80 bars and 135 bars.

According to a supplementary aspect of the invention, when the high pressure of the refrigerant fluid is substantially greater than or equal to 135 bars, the variable expansion means fully open the first orifice 34.

In the embodiment where the expansion means comprise a plugging mechanism 1271, the stopper 137 of the expansion mechanism can be made to plug the third orifice 37, when the pressure Hp of the refrigerant fluid in the inlet chamber 1210 is substantially lower than 135 bars, and to open the third orifice 37, when the pressure Hp of the refrigerant fluid in the inlet chamber 1210 is substantially greater than or equal to 135 bars.

The characteristics of the auxiliary spring system 351 of the relief valve can be selected so that the stopper 137 plugs the third orifice 37, when the pressure Hp of the refrigerant fluid in the inlet chamber is substantially less than 135 bars, and fully opens up the third orifice when the high pressure of the refrigerant fluid is substantially greater than 135 bars.

The operation of the expansion device will now be described in greater detail, in reference to the embodiment with a plugging mechanism.

At a low heat load, the user's demand for cold is low and/or the external temperature is low. The high pressure Hp of the refrigerant fluid is then substantially between 0 and 80 bars. Under these conditions, the stopper 137 plugs the third orifice 37 and the adjusting screw 134 closes the first orifice 34.

The expansion is thus achieved by the second orifice 35. The equivalent flow section of the expansion device 12 then corresponds to the flow section of the second orifice 35, and is therefore substantially between 0.07 $mm^2$ and 0.16 $mm^2$. This value enables the high pressure to be returned to its optimal zone, therefore in the vicinity of 80 bars.

The adjusting screw 134 starts to open the first orifice 34 when the high pressure of the refrigerant fluid is in the vicinity of 80 bars.

At a higher heat load, the high pressure Hp of the refrigerant fluid is substantially between 80 bars and 135 bars. The stopper 137 once again plugs the third orifice 37 and the adjusting screw 134 starts to open the first orifice 34.

The flow section of the first orifice then starts to develop depending on the high pressure Hp, in a generally increasing manner.

The expansion is again achieved by the first orifice 34 and by the second orifice 35. The equivalent flow section of the expansion device 12 therefore corresponds to the sum of the constant flow section of the second orifice 35 and of the variable flow section of the first orifice 34. The equivalent flow section of the expansion device 12 then develops depending on the high pressure, in a generally increasing manner.

At a high heat load, the user's demand for cold is high and/or the external temperature is high. The high pressure Hp of the refrigerant fluid is then substantially greater than 135 bars. When the high pressure of the refrigerant fluid is in the vicinity of 135 bars, the stopper 137 opens the third orifice and the adjusting screw fully opens the first orifice 34.

The expansion is then achieved by the first orifice 34, the second orifice 35 and the third orifice 37. The equivalent flow section of the expansion device 12 is therefore substantially constant and corresponds to the sum of the flow section of the second orifice 35, the maximum flow section of the first orifice 34 and the flow section of the third orifice 37.

The change in the equivalent flow section of the expansion device 12, depending on the high pressure Hp, is illustrated by the curve in FIG. 5. In the example in FIG. 5, this curve is made up of several straight line segments.

In the low heat load phase, the high pressure is substantially lower than the value Hp1, which is substantially equal to 80 bars. The first orifice 34 is closed by the adjusting screw 134 and the third orifice 37 is closed by the stopper 137, so that the expansion is achieved by the second orifice 35.

The equivalent flow section of the expansion device 12 is equal to the passageway surface of the second orifice 35, and is therefore between 0.07 $mm^2$ and 0.16 $mm^2$, which makes it possible to return the high pressure to its optimal zone and to have a coefficient of performance COP that is barely or not at all reduced.

From the pressure value Hp1, of about 80 bars, the first orifice 34 starts to open.

At a higher heat load, the high pressure Hp is substantially between the value Hp1, which is about 80 bars, and the value Hp3, which is about 135 bars. The second orifice 35 is open and the third orifice 37 is closed. In the example of FIG. 5, the flow section of the first orifice 34 increases substantially linearly with the high pressure Hp of the refrigerant fluid. The expansion is achieved by the first orifice 34 and the second orifice 35. The equivalent flow section of the expansion device therefore changes substantially linearly with the high pressure Hp.

In particular, it reaches a value S2, substantially between 0.45 $mm^2$ and 0.63 $mm^2$, when the high pressure of the refrigerant fluid is equal to the value Hp2, which is about 110 bars.

When the high pressure of the refrigerant fluid reaches the value Hp3, which is about 135 bars, the flow section has a value S3, substantially between 0.71 $mm^2$ and 0.95 $mm^2$.

Furthermore, when the high pressure of the refrigerant fluid reaches the value Hp3, which is about 135 bars, the adjusting screw 134 fully opens the first orifice 34 whereas the stopper 137 rises in order to open the third orifice 37. The expansion is then achieved by the first orifice 34, the second orifice 35 and the third orifice 37. The equivalent flow section of the expansion device then moves to the value S4 which is substantially between 2 $mm^2$ and 6.1 $mm^2$ then remains constant. The value S4 can correspond to an equivalent diameter substantially between 1.6 mm and 2.8 mm.

Figure 6:
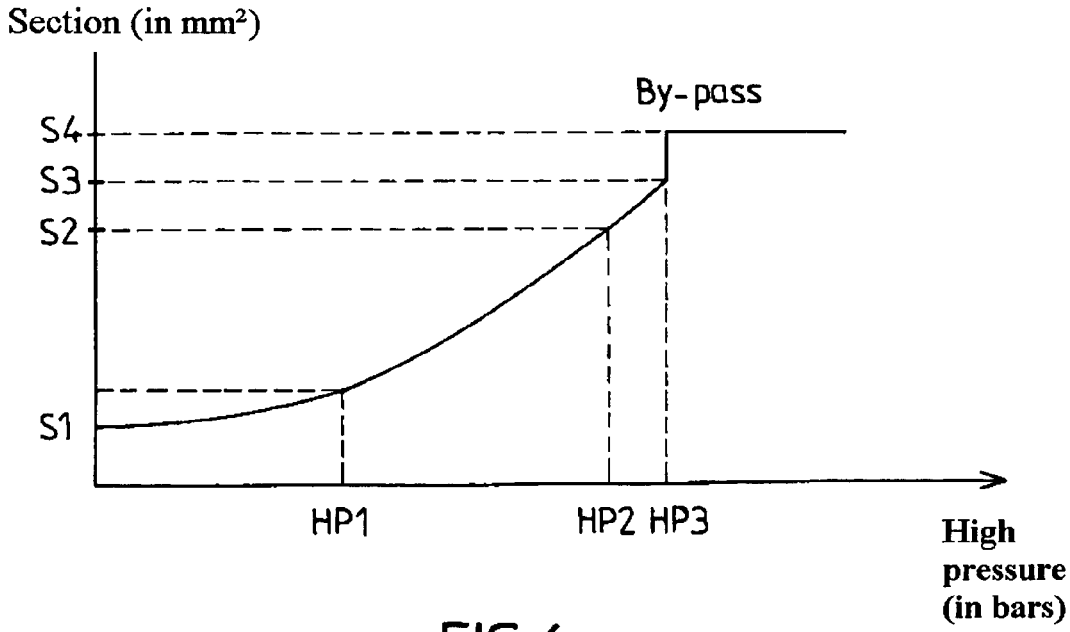
FIG. 6 is a diagram illustrating another example of a change in the flow section of an expansion device according to the invention depending on the high pressure.

The curve in FIG. 6 illustrates another example of a change in the equivalent flow section of the expansion device 12 depending on the high pressure Hp. In the example of FIG. 6, this curve has an overall exponential form.

The curve in FIG. 6 corresponds to an adjusting screw 134 form and to spring stiffnesses different from those used in the corresponding expansion device in FIG. 5. This form enables the reactivity of the expansion device to be increased for very high values of the high pressure. Such a curve can be obtained, for example, by means of a non-linear spring.

As described in reference to FIG. 5, the equivalent flow section of the expansion device in FIG. 6 goes through values S1, S2 and S3 when the high pressure of the refrigerant fluid respectively reaches values Hp1, Hp2 and Hp3 and remains equal to the value S4 when the high pressure of the refrigerant fluid is substantially greater than or equal to 135 bars.

The expansion device according to the invention therefore enables a maximum coefficient of performance COP, which principally depends on the high pressure, to be obtained.

Furthermore, the expansion device 12 is designed so as to obtain a change in the equivalent flow section of the expansion device substantially independent of the low pressure. It is therefore the high pressure that requires the equivalent flow section of the expansion device and the coefficient of performance. Consequently, the structure of the expansion device does not have any refrigerant fluid return at low pressure from the outlet chamber 1230 into the inlet chamber 1210. The structure of the expansion device is therefore simplified.

Of course, the invention is not restricted to the aforementioned embodiments. It encompasses any alternative embodiment that might be envisaged by those skilled in the art.

The invention claimed is:

1. A supercritical refrigerant fluid (FR), expansion device, for an air conditioning system comprising: a body (120) comprising an inlet chamber (1210) in which the refrigerant fluid enters and an outlet chamber (1230) through which the refrigerant fluid departs; and a set of expansion means to allow the refrigerant fluid to pass from the inlet chamber (1210) into the outlet chamber (1230);

wherein the expansion means comprises:

a variable expansion means (1212) comprising a first orifice (34) leading directly from the inlet chamber (1270) into the outlet chamber (1230), and an adjusting screw (134) suitable for adjusting the flow section of the first orifice (34); and, a fixed expansion means comprising a second orifice (35) leading directly from the inlet chamber (1270) into the outlet chamber (1230), with a fixed flow section.

2. Expansion device according to claim 1, wherein the first orifice (34) and the second orifice (35) are adjacent and non-intersecting.

3. Expansion device according to claim 1, wherein the first orifice (34) and the second orifice (35) are arranged in such a way as to create a common orifice.

4. Expansion device according to claim 1, wherein the expansion means are designed so that the minimum flow section of the expansion device (12) is substantially between 0.07 $mm^2$ and 0.16 $mm^2$.

5. Expansion device according to claim 4, wherein the expansion means are arranged so that the flow section of the expansion device is substantially between 0.45 $mm^2$ and 0.63 $mm^2$, when the pressure of the refrigerant fluid is substantially about 110 bars.

6. Expansion device according to claim 4, wherein the expansion means are arranged so that the flow section of the expansion device is substantially between 0.71 $mm^2$ and 0.95 $mm^2$, when the pressure of the refrigerant fluid is substantially about 135 bars.

7. Expansion device according to claim 4, wherein the expansion means are arranged so that the flow section of the expansion device is substantially between 2 $mm^2$ and 6.1 $mm^2$, when the pressure of the refrigerant fluid is substantially greater than 135 bars.

8. Expansion device according to claims 2, wherein the flow section of the second orifice (35) is substantially between 0.07 $mm^2$ and 0.16 $mm^2$.

9. Expansion device according to claim 2, wherein the adjusting screw (134) is designed to close the first orifice (34) when the pressure of the refrigerant fluid is substantially lower than 80 bars and to open the first orifice (34), at least partially, when the pressure of the refrigerant fluid in the inlet chamber (1210) is substantially greater than or equal to 80 bars.

10. Expansion device according to claim 9, wherein the adjusting device (134) is designed to adjust the flow section of the first orifice (34) in a generally increasing manner depending on the pressure of the refrigerant fluid in the inlet chamber (1210), when the pressure of the refrigerant fluid in the inlet chamber (1210) is substantially between 80 bars and 135 bars.

11. Expansion device according to claim 1, wherein the adjusting screw (134) is designed to maintain a maximum opening of the first orifice (34), when the pressure of the refrigerant fluid in the inlet chamber (1210) is substantially greater than or equal to 135 bars.

12. Expansion device according to claim 1, wherein the expansion means further comprise a plugging mechanism (1271) comprising a third orifice (37) and a stopper (137) for plugging said third orifice.

13. Expansion device according to claim 9, wherein the expansion means further comprise a plugging mechanism (1271) comprising a third orifice (37) leading directly into the outlet chamber (1230) and a stopper (137) for plugging said third orifice; and the stopper (137) is designed to plug the third orifice (37) when the pressure of the refrigerant fluid in the inlet chamber (1210) is substantially less than 135 bars, and to open the third orifice (35) when the pressure of the refrigerant fluid in the inlet chamber (1210) is substantially greater than or equal to 135 bars.

14. Expansion device according to claim 1, wherein the variable expansion means (1211) further comprise a spring system (350) arranged to apply a force on the adjusting screw (134) in opposition to the force applied by the pressure of the refrigerant fluid in the inlet chamber (1210).

15. Expansion device according to claim 14, wherein the variable expansion means (1210) are inserted into a recess (1212) in the inlet chamber and in that the adjusting screw (134) comprises a spindle (135) substantially perpendicular to the axis of the first orifice, attached at one of its ends to the base of the recess, mechanically connected to a partition (340) on which, on one hand, the force of the spring system (350) is applied and, on the other hand, the force of the pressure of the entering refrigerant fluid is applied, so that the adjusting screw is suitable for moving in translation, substantially perpendicular to the axis of the orifice.

16. Expansion device according to claim 1, wherein the refrigerant fluid is the R744 fluid.

17. Air conditioning system, operating with a refrigerant fluid and comprising a compressor (14), a gas cooler (11), an expansion device (12) and an evaporator (13), and comprising the expansion device of claim 1.

18. Air conditioning system, operating with a refrigerant fluid and comprising a compressor (14), a gas cooler (11), an expansion device (12) and an evaporator (13), and comprising the expansion device of claim 4.

19. Air conditioning system, operating with a refrigerant fluid and comprising a compressor (14), a gas cooler (11), an expansion device (12) and an evaporator (13), and comprising the expansion device of claim 12.

20. Air conditioning system, operating with a refrigerant fluid and comprising a compressor (14), a gas cooler (11), an expansion device (12) and an evaporator (13), and comprising the expansion device of claim 14.

* * * * *